US005149085A

United States Patent [19]

Sanchez

[11] Patent Number: 5,149,085

[45] Date of Patent: Sep. 22, 1992

[54] TRAINING AID FOR SHOOTING A BASKETBALL

[76] Inventor: William Sanchez, 620 Beech, Clio, Mich. 48420

[21] Appl. No.: 825,401

[22] Filed: Jan. 22, 1992

[51] Int. Cl.[5] ..... A63B 69/00

[52] U.S. Cl. ..... 273/1.5 A

[58] Field of Search ..... 273/1.5, 183

[56] References Cited

U.S. PATENT DOCUMENTS

| | | | |
|---|---|---|---|
| 3,707,730 | 1/1973 | Slider | 273/1.5 A X |
| 3,918,721 | 11/1975 | Trask, Jr. | 273/183 B X |
| 4,222,569 | 9/1980 | De Mascolo | 273/183 B |
| 4,805,905 | 2/1989 | Haub | 273/1.5 A |
| 4,881,275 | 11/1989 | Cazares et al. | 273/1.5 A |

*Primary Examiner*—Paul E. Shapiro

*Attorney, Agent, or Firm*—Weintraub, DuRoss & Brady

[57] ABSTRACT

An athletic training device is provided for determining the forward rotation of the hand in relation to the wrist of an athlete. The device comprises a pair of bands, a first band disposed about the wrist and a second band disposed about the knuckles of a hand of an athlete. A strap is connected between the two bands. The length of the strap is greater than the distance between the two bands when the hand is not rotated forwardly. When the wrist is rotated forwardly, the strap is placed under tension and pulled toward the hand of the athlete. This movement of the strap triggers a sensing mechanism, which in turn closes a circuit and triggers a signalling mechanism. Thus, an athlete can determine when complete forward rotation of his or her wrist has occurred. In a preferred embodiment, the signalling mechanism includes an audible sound generating device.

8 Claims, 2 Drawing Sheets

FIG 1
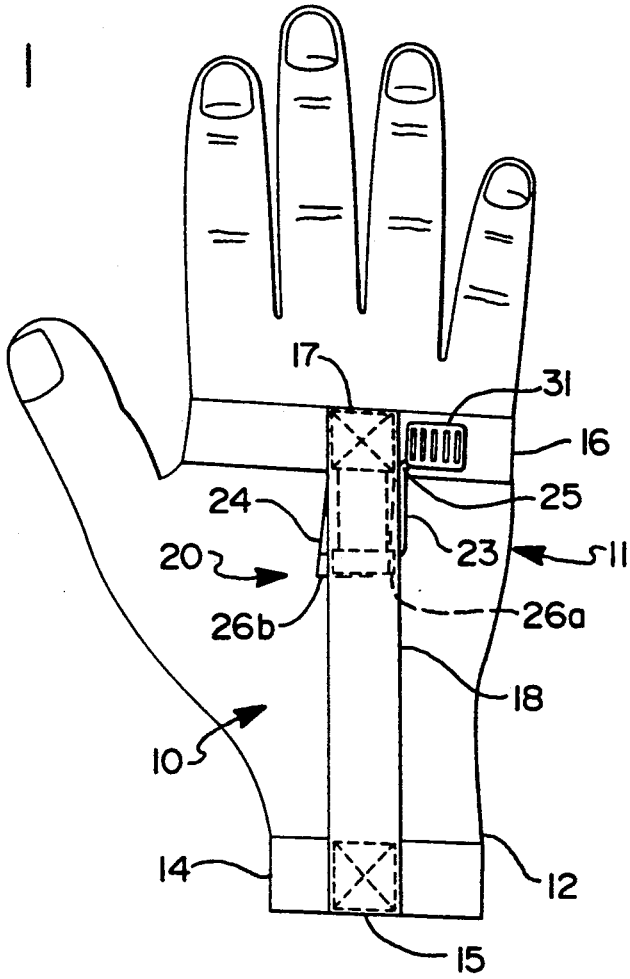
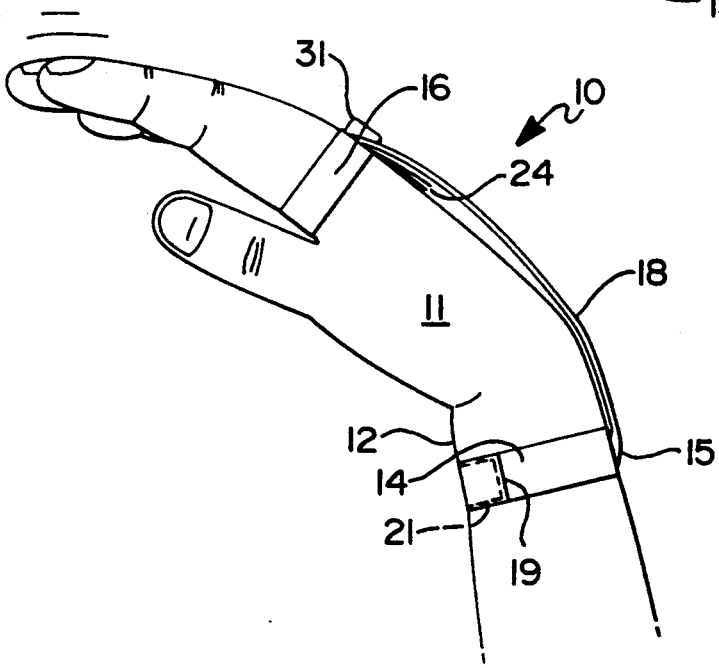
FIG 3

FIG 4
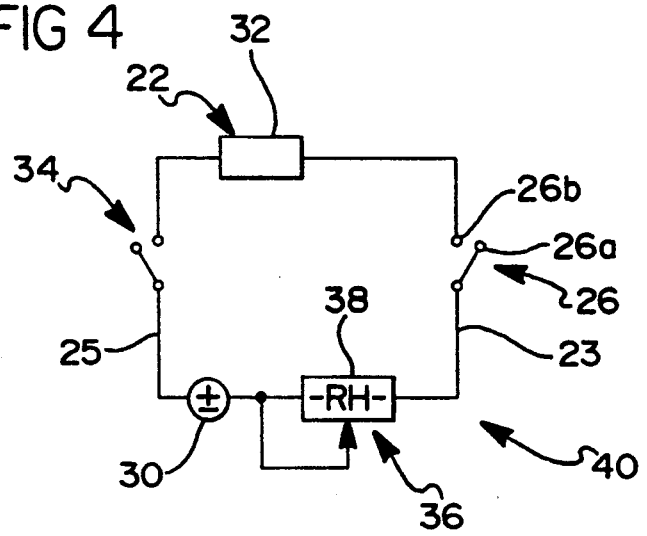
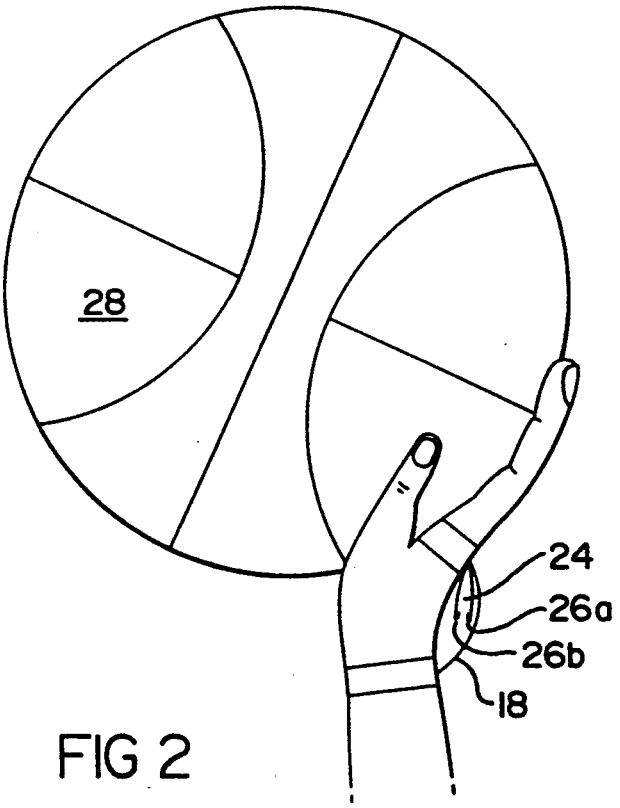
FIG 2

TRAINING AID FOR SHOOTING A BASKETBALL

BACKGROUND OF THE INVENTION

1. Field of the Invention

The present invention relates to instructional aids for learning proper athletic technique. More specifically, the present invention relates to a training device to help teach a basketball player proper shooting technique.

2. Prior Art

Proper basketball shooting techniques have been the subject of much research, with the heightened interest in high school, college and professional basketball. It has been determined that the proper way to shoot a basketball is for the shooter to hold his or her forearm perpendicular to the floor. The basketball is held on the fingertips in the shooting hand, and is balanced with the other hand, usually on the side of the ball. In launching the shot, the shooter raises the upper arm while keeping the forearm perpendicular to the floor. The hand is then rotated forwardly about the wrist, such that the ball rolls off of the fingertips and assumes a curved tracectory.

Most troublesome for many shooters is the proper rotation of the hand about the wrist during the shot. Proper wrist and hand "follow-through" is a key step in proper shooting technique. A device that would help a basketball shooter develop and master this technique would help a player improve his or her shooting.

One such device is taught in U.S. Pat. No. 4,805,905 issued Feb. 21, 1989 to Haub. The device of Haub comprises a wristband disposed on the shooting arm of a basketball shooter, proximate to the wrist. A tube extends forwardly from the wrist band, the tube being made of a flexible material. A solid feeler element is mounted perpendicularly on the flexible tube. The player attaches the wristband onto the shooting arm. The tube is then adjusted such that the feeler element is positioned to contact the shooter's hand when the shooter follows through with the hand about the wrist. The theory is that a shooter will attempt to follow through in order to contact the feeler element and develop consistent shooting habits.

The device of Haub, however, presents problems. Firstly, the flexible tube can be moved when contacted by the hand during the follow through. This may move the feeler element, causing the necessity of resetting the element or placing the feeler element in an unreachable position. Further, the device, in particular the tubing and feeler element, add weight to the front of the shooter's arm. This added weight must be compensated for by the shooter, which can throw off his shooting technique. Finally, unless a shooter uses a technique that requires the full rearward rotation of the hand about the wrist, a technique which many coaches do not recommend, the basketball may be interfered with by the feeler element. This could have a tendency to frustrate any training benefit which would otherwise be potentially offered by the device of Haub.

Other known basketball training devices are described in U.S. Pat. Nos. 3,280,783 to Caveness, 4,377,284 to Okerlin, 4,383,685 to Bishop, and 4,579,341 to Furr.

While some basketball training aids are known and commercially available, most of the known devices known to Applicant are bulky and cumbersome. A need exists in the art for improved lightweight devices to help train basketball players in proper shooting technique, and particularly proper follow-through in shooting free throws. In particular, a device is needed which will not interfere in any way with the basketball, or with the normal freedom of motion of the shooter.

SUMMARY OF THE INVENTION

The present invention overcomes the problems of the known basketball training aids and presents a device that will not interfere with the shooting of the basketball. Further, the present invention will work in multiple starting positions of the basketball on the shooter's hand.

The present invention provides a device for training a basketball player in proper shooting techniques. The device according to the present invention is adapted to be disposed on a wrist and a hand of the shooting arm of the player and comprises:

(a) a first band adapted to be placed substantially surrounding the wrist of the shooting arm hand of the player;

(b) a second band adapted to be disposed substantially surrounding a portion of the hand of the shooting arm of the player;

(c) a strap connected at a first end thereof to the first band, and at a second end thereof to the second band, the strap being placeable under tension in relation to rotation of the hand about the wrist;

(d) means for sensing the position of the strap in relation to the hand; and (e) means for signalling proper rotation of the hand in relation to the wrist.

For a more complete understanding of the present invention, the reader is referred to the following detailed description section, which should be read in conjunction with the accompanying drawings. Throughout the detailed description and in the drawings, like reference numbers refer to like parts in each of the several views, in which:

BRIEF DESCRIPTION OF THE DRAWINGS

FIG. 1 is a top plan view of the hand and wrist of a user wearing the training device of the present invention;

FIG. 2 is a side elevational view of the training device of the present invention disposed on a non-extended wrist;

FIG. 3 is a side elevational view of the training device of the present invention disposed on a wrist that has been fully forwardly extended; and FIG. 4 is a schematic diagram of an electrical circuit in accordance with the present invention.

DETAILED DESCRIPTION OF THE EMBODIMENT

With reference to FIGS. 1-3, there is shown the training device 10 of the present invention. The training device 10 is adapted to be placed, as shown in FIGS. 2 and 3, on the hand 11 and wrist 12 of a basketball shooter. The training device 10 comprises a first band or wristband 14, a second band or hand band 16, a strap 18 which interconnects the first and second bands, means 20 for sensing the position of the strap 18 with respect to the hand 11 of the shooter, and means 22 for signalling the necessary forward rotation of the hand 11 in relation to the wrist of the shooter. The first band 14 is adapted to be disposed surrounding the wrist 12 of a basketball shooter. The first band 14 comprises a substantially circular ring made of a comfortable cloth, elastic or other similar material. Alternatively, the first band 14 could be a solid "C"-shaped band for substantially surrounding the wrist 12.

The second band 16 is adapted to be disposed surrounding the hand 11 of the basketball shooter near the base of the thumb proximate to the knuckles of the hand, as shown in FIGS. 1-3. The second band 16 is, preferably, like the first band, a circular ring formed of an elastic or elastic-cloth material that is comfortable and flexible. The second band 16 could be replaced with a ring to surround the player's index finger, the strap 18 attaching thereto in place of the band 16. However, it is preferred that the second band 16 be adapted to surround at least a portion of the hand 11.

If desired, either of the first band 14 or the second band 16 may have a slit 19 separating the otherwise circular band into a flat strip having two ends. If made in such a flat strip, the first or second band may then be secured to itself upon the wrist or hand of the basketball shooter by reconnecting the band with a snap or "VELCRO" fastener 21 or other similar fastening means. The slitting of the band and its securement via a suitable fastener gives the device greater flexibility in the shooters who may utilize it. In the preferred embodiment hereof, the first band 14 is formed in a fastenable strip which includes means 21 for fastening, and the second band 16 is formed of elastic-reinforced cloth material which can be slipped over the hand 11.

A strap 18, which is preferably formed of a durable woven material, is attached at a lower end 15 thereof to the first band 14 and at an upper end 17 thereof to the second band 16, and the strap 18 interconnects the first and second bands 14, 16. The strap 18 is formed in a length greater than the distance between the knucles and wrist on the arm of the shooter, when the hand is extended rearwardly from the wrist 12. As can be seen in FIG. 2, the band 18 bows away from the hand of the shooter when the hand is in a rearwardly extended or an unextended position. Therefore, when the hand is disposed substantially parallel to the forearm, the strap 18 is still bowed out as shown and is not placed under tension. This is due to the fact that the strap 18 is longer than the distance between the first band 14 and second band 16 as properly placed on the hand 11 and wrist 12 as shown deployed in FIG. 2. When referring to FIG. 3, it is seen that the hand 11 of the shooter is rotated forwardly about the wrist 12 as the ball 28 is released. The strap 18 is then placed under tension as the distance between the first and second bands 14, 16 becomes greater and the strap 18 more closely conforms to the contours of the hand 11 of the shooter. This tension on the strap 18 allows for the sensing of the position of the hand 11 by closing a contact switch 26 to complete a circuit 40 and signal the position of the hand in relation to the wrist, and to provide positive reinforcement of proper shooting technique, as will be described in further detail hereinbelow.

In the depicted embodiment 10, means 20 for sensing the position of the hand in relation to the wrist of the shooter comprises a connecting strip 24 which is attached to the second band 16 or to the strap 18, and a pair of electrical contacts, denoted as **26*a* and 26*b*. A first electrical contact 26*a* is attached to the underside of the strap 18, while a second electrical contact 26*b* is attached to the connecting strip 24 immediately below the first contact 26*a***.

The strip 24 may include a piece of durable woven material, similar to the strap 18. In one embodiment, the strip 24 may be formed from a spring-like electroconductive material such as spring steel. The strip 24 is normally biased away from the strap 18, and a weak spring (not shown) may be provided to bias the strip 24 away from the strap 18 until such time as the strap 18 is placed under tension. The strip 24 is secured to the second band 16 and/or to the strap 18 and is disposed substantially underneath the strap 18. At the lower end of the strip 24 there is deployed the electrical contact **26*b*. As noted, the corresponding contact 26*a* is mounted on the underside of the strap 18 proximate to the first contact 26*b*. The contacts 26*a*, 26*b* will only make contact with one another to complete the electrical circuit 40 when the hand of the shooter is rotated fully forwardly about the wrist as shown in FIG. 3, and the strap 18 is placed under tension and conforms closely to the shape of the hand 11** of the shooter.

The sensing means 20 forms a part of a normally open electrical circuit 40, which further includes a miniature battery 30 which may be disposed within a housing 31 on the device 10. The device 10 hereof could be manufactured and sold without the battery 30 so long as it is designed to receive a battery 30. While the housing 31 which houses the battery 30 is shown in FIGS. 1 and 3 as being located on the second band 16, it will be understood that the housing 31 may be placed anywhere on the device 10, as convenience dictates. Similarly, the strip 24 could extend upwardly from the first band 14 rather than downwardly from the second band 16, as shown. One pole of the battery 30 is connected by suitable wiring 23 to the first contact **26*a*, while the other pole of the battery 30 is connected by suitable wiring 25 to the second contact 26*b*, with a means 22 for signalling completion of the circuit 40 being disposed in series between the contact 26*b* and the battery. The circuit 40 may, optionally, also include an on-off switch 34 to allow the player to temporarily disengage the device 10, and the circuit 40 may further include a volume control 36 such as the rheostat 38 shown in FIG. 4 to allow the player to adjust the volume of sound produced from the signalling means 22 to an optimal or preferred level. A normally open circuit 40 is thus defined between the battery 30, the sensor 20, and the means 22 for signalling. In a preferred embodiment hereof, the means 22 for signalling is a piezoelectric beeper device 32 such as is known in the art. A sound generating device is preferred, rather than alight or other means for producing a visual signal, as the means 22 for signalling, in order to allow the player to watch the basketball hoop (not shown) after the ball 28 leaves the hand 11**.

Relaxation of the wrist and complete follow-through of the hand is critical to proper shooting technique. The device 10 of the present invention audibly reinforces such complete follow-through, providing positive reinforcement to signal proper rotation of the hand in relation to the wrist.

With reference to FIGS. 2 and 3, the operation of the present device will now be further explained. When a shooter has a ball positioned upon his or her hand, as shown in FIG. 2, the strap 18 of the device 10 is bowed away from the arm of the shooter, and is not placed under tension. This action occurs due to the length of the strap 18 and the spatial relationship between the first band 14 and second band 16. When the hand is extended rearwardly as in FIG. 2, the strip 24 remains spaced away from the strap 18 and relatively close to the hand of the shooter. Thus, when the hand of the shooter is in a rearwardly rotated position, as shown in FIG. 2, no contact is made by the means 20 for sensing the position of the strap 18. This can be seen by the gap between the contacts 26*a* and 26*b*. Referring now to FIG. 3, wherein the hand of the shooter is rotated fully forwardly, it can be seen that the position of the strip 24 and the sensor 26*b* mounted thereon is relatively the same as in FIG. 2. The strap 18, however, has been placed under tension as it is drawn into contact with the wrist and the back of the hand 11 of the shooter. This is due in part to the relative movement of the second band 16 away from the first band 14. Thus, the electrical contact 26*a* mounted on the strap 18 is brought into touch with the electrical contact 26*b* mounted on the strip 24. Thus, the circuit 40 is closed and the sensor 20 may relay a signal to the means 22 for signalling full forward rotation of the hand in relation to the wrist of the shooter.

As noted, a preferred means 22 for signalling forward rotation of the hand in relation wrist is a piezoelectric buzzer, as is commonly known in the electronic arts. The means 22 for signalling, may optionally include an extension wire and an earplug (not shown) which extend outwardly away from the housing 31. The wire is of such length to allow the plug (not shown) to be deployed in or near the ear of the shooter. Thus, the shooter can hear instantaneously when the proper rotation of the wrist has been achieved.

The present invention offers significant advantages over the art known to applicant. The components of the present device 10 are lightweight, and therefore offer no substantial weight which may alter the shooting style of the player, as can happen with previously known devices. Further, no physical structures extend forwardly from the device. Thus, the basketball will not be interfered with during the shooting process. Nor, additionally, can the calibration of the means for sensing be disturbed, as can happen in the prior art device.

It is also important to note that while the present invention has been described in its use in serving as a training aid for athletes shooting a basketball, the present invention has applications in other sporting activities and training.

Although the present invention has been described herein with respect to a preferred embodiment hereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Having, thus, described the invention, what is claimed is:

1. A device for training a basketball player in proper shooting technique, the device adapted to be disposed on the player's wrist and hand and comprising:

(a) a first band adapted to be placed substantially surrounding the wrist of the player;

(b) a second band adapted to be disposed substantially surrounding a portion of the hand of the player;

(c) a strap connected at a first end thereof to the first band and at a second end thereof to the second band, the strap being placeable under tension in relation to rotation of the hand about the wrist;

(d) means for sensing the position of the strap in relation to the hand; and (e) means for signalling proper rotation of the hand in relation to the wrist.

2. The device of claim 1, wherein the sensing means comprises an electrical switch which is normally open and which is disposed substantially below the strap, the switch comprising a pair of electrical contacts.

3. The device of claim 1, wherein the signalling means comprises a sound generating device.

4. The device of claim 3, wherein the sound generating device is a piezoelectric buzzer.

5. A device for training a basketball player in proper shooting technique, the device being adapted to be placed on the player's wrist and hand and comprising:

(a) a first band adapted to be placed substantially surrounding the wrist of the player;

(b) a second band adapted to be placed substantially surrounding a portion of the hand of the player;

(c) a strap interconnecting the first band to the second band;

(d) an electrical switch which is normally open and which is disposed substantially below the strap, the switch comprising a pair of electrical contacts; and (e) a sound generating device which is adapted to generate a sound when the switch is closed to complete an electrical circuit.

6. The device of claim 5, wherein the sound generating device is a piezoelectric buzzer.

7. A method of using a basketball training device to signal correct follow-through of a hand of a player as the hand is rotated around the player's wrist, comprising the steps of:

(a) placing a basketball training device on the wrist and hand of a player, the device comprising:

(i) a first band adapted to be placed substantially surrounding the wrist of the player;

(ii) a second band adapted to be disposed substantially surrounding the hand of the player;

(iii) a strap connected at a first end thereof to the first band and at a second end thereof to the second band, the strap being placeable under tension in relation to the rotation of the hand about the wrist;

(iv) means for sensing the position of the strap; and (vi) means for signalling proper rotation of the hand in relation to the wrist;

(b) extending the player's hand rearwardly to bow the strap outwardly away from the wrist; and (c) rotating the hand forwardly about the wrist until the sensing means senses tension on the strap and actuates the signalling means to generate a signal.

8. The method of claim 7, wherein the signal generated is a sound.

* * * * *